United States Patent [19]

Longly et al.

[11] Patent Number: 5,057,807

[45] Date of Patent: Oct. 15, 1991

[54] KEYBOARD SWITCH

[75] Inventors: James M. Longly, Lexington; David G. Knapp, Cozad, both of Nebr.

[73] Assignee: Veetronix, Inc., Lexington, Nebr.

[21] Appl. No.: 495,898

[22] Filed: Mar. 19, 1990

[51] Int. Cl.[5] ..... H01H 9/00

[52] U.S. Cl. ..... 335/207; 335/206; 335/202

[58] Field of Search ..... 335/205–207, 335/202; 200/295, 303

[56] References Cited

U.S. PATENT DOCUMENTS

| | | | |
|---|---|---|---|
| 3,243,544 | 3/1966 | Mayer . | |
| 3,488,613 | 1/1970 | Marchetti . | |
| 3,512,553 | 5/1970 | Legris . | |
| 3,652,964 | 3/1972 | Chamberlain . | |
| 3,736,397 | 5/1973 | Pedersen . | |
| 3,753,179 | 8/1973 | Straub . | |
| 3,942,145 | 3/1976 | Sobczak | 335/207 |
| 4,015,226 | 3/1977 | Stomma et al. | 335/206 |
| 4,041,427 | 8/1977 | Chusha . | |
| 4,074,095 | 2/1978 | Romanowski . | |
| 4,130,745 | 12/1978 | Hetzer . | |
| 4,142,168 | 2/1979 | Natland . | |
| 4,211,991 | 7/1980 | Lombard et al. . | |
| 4,336,518 | 6/1982 | Holce et al. . | |
| 4,346,360 | 8/1982 | Deltufo . | |
| 4,447,859 | 5/1984 | Raczynski . | |
| 4,456,897 | 6/1984 | Holce et al. . | |

*Primary Examiner*—Leo P. Picard
*Assistant Examiner*—Lincoln Donovan
*Attorney, Agent, or Firm*—Emrich & Dithmar

[57] ABSTRACT

The switch comprises a square, hollow housing. A base plate and a cover plate are snap fitted in stacked relationship. First and second elongated cavities in the base plate are respectively aligned with first and second cavities in the cover plate and within these aligned cavities are respectively located two elongated reed switches. A plunger is slidably carried by the housing and movable toward and away from the plates. The plunger carries two pairs of magnets respectively aligned with the reed switches. When the plunger is depressed, the magnets move into close proximity with the reed switches, closing them. A spring biases the plunger away from the reed switches, whereby the reed switches are normally open.

29 Claims, 4 Drawing Sheets

KEYBOARD SWITCH

BACKGROUND OF THE INVENTION

U.S. Pat. No. 3,753,179, assigned to the assignee of this application, discloses a keyboard switch containing reed switches oriented vertically. As a result, the height of the keyboard switch is substantial and requires additional wire to be welded to the leads of the reed switches. U.S. Pat. No. 4,346,360 to Del Tufo discloses orienting a reed switch horizontally, thereby reducing the height and avoiding the welding step. However, structure in the Del Tufo patent used to mount the reed switches has shortcomings.

SUMMARY OF THE INVENTION

It is therefore an important object of the present invention to horizontally mount magnetically actuated switches in a keyboard switch in an improved way.

Another object is to provide structure to interlock a plurality of keyboard switches.

In summary, there is provided a keyboard switch for mounting on a PC board comprising a housing, a base plate and a cover plate interconnected in stacked relationship and mounted on the housing, at least one of the plates having an elongated cavity therein, a plunger slidably carried by the housing and movable in first and second predetermined directions respectively toward and away from the plates, magnet means carried by the plunger and movable therewith, means biasing the plunger in one of the predetermined directions, an elongated magnetically actuated switch in the elongated cavity and having opened and closed positions, the elongated magnetically actuated switch being opened in response to movement of the plunger in one of the predetermined directions and being closed in response to movement of the plunger in the other of the predetermined directions.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
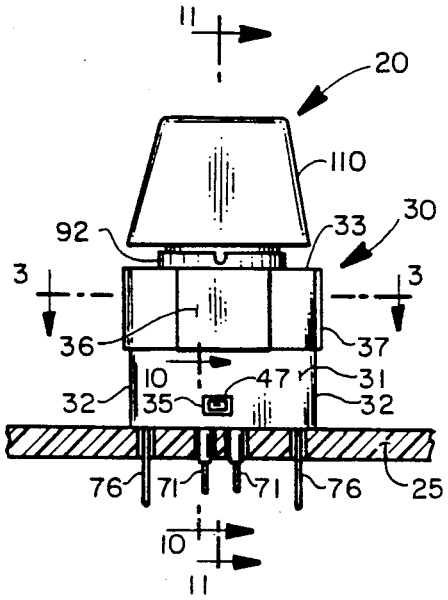
FIG. 1 is an elevational view of a keyboard switch incorporating the features of the present invention, mounted on a PC board.
Figure 2:
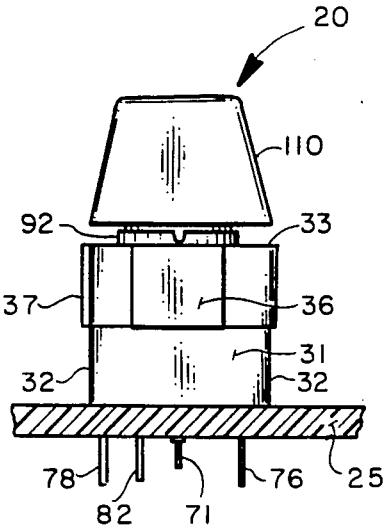
FIG. 2 is an elevational view of the keyboard switch rotated 90° with respect to FIG. 1.
Figure 3:
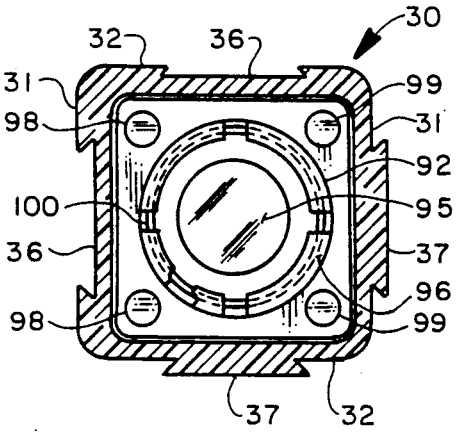
FIG. 3 is a view in horizontal section taken along the line 3—3 of FIG. 1, on an enlarged scale.

Turning now to the drawings, there is depicted a keyboard switch 20 which incorporates the features of the present invention. It is mounted on a PC board 25. The keyboard switch 20 comprises a hollow housing 30 which is generally square in transverse cross section and includes two opposite side walls 31, two opposite side walls 32 and an end wall 33. A relatively large, central hole 34 is in the end wall 33. Respectively in the side walls 31, adjacent to their free ends, are two generally square apertures 35. In one of the side walls 31 and in one of the side walls 32 are dovetail grooves 36. On the other of the side walls 31 and on the other of the side walls 32 are dovetail tongues 37.

Figure 5A:
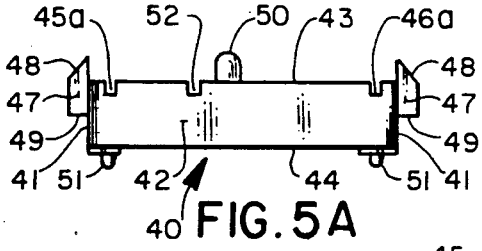
FIG. 5A is an elevational view of the base plate in the keyboard switch.
Figure 5B:
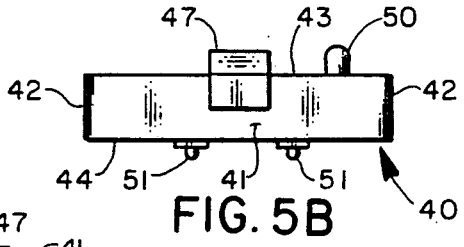
FIG. 5B is an elevational view of the base plate rotated 90° with respect to FIG. 5A.
Figure 6:
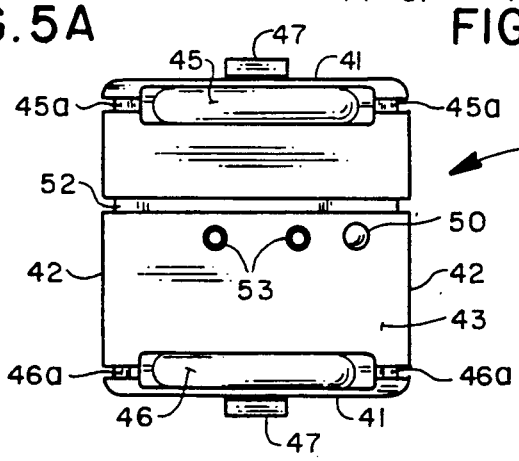
FIG. 6 is a top plan view of the base plate.
Figure 4:
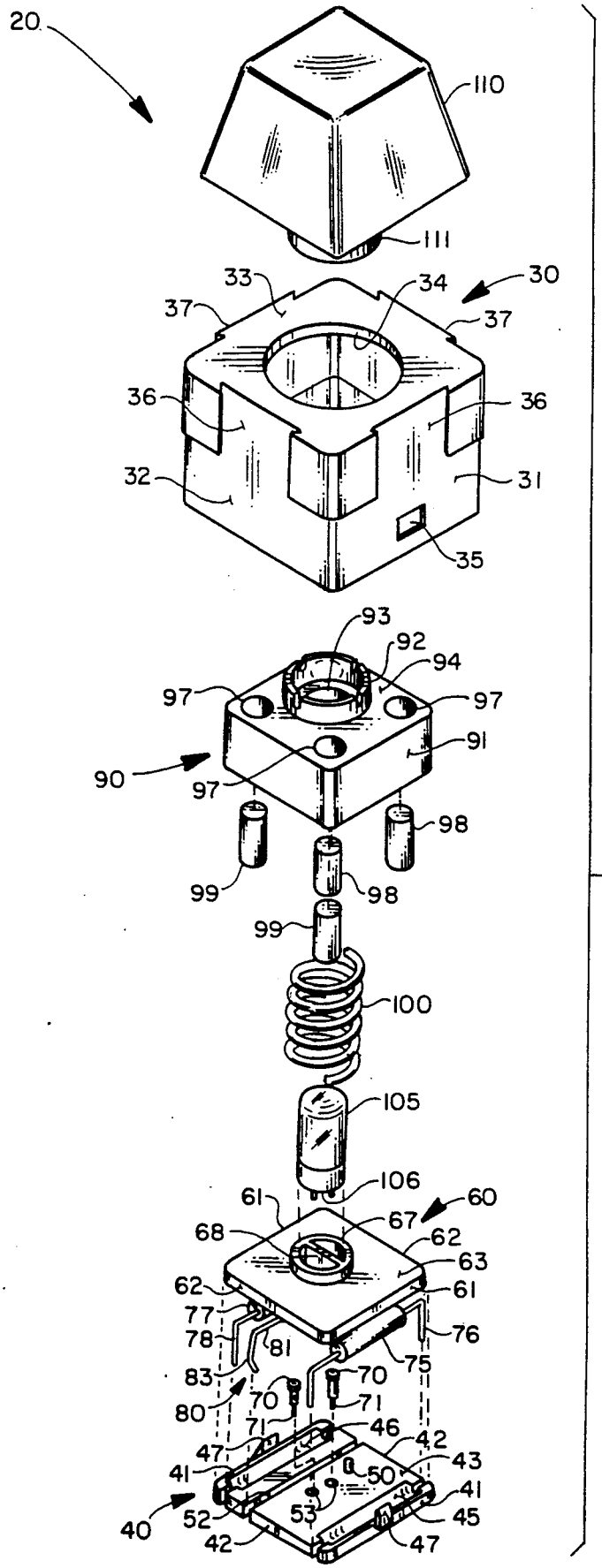
FIG. 4 is an exploded view of the keyboard switch.

The keyboard switch 20 further comprises a base plate 40 best seen in FIGS. 5A, 5B and 6. The base plate 40 is generally square in plan, having two opposite sides 41 and two opposite sides 42. The base plate 40 has an upper surface 43 and a lower surface 44 which are parallel. Located in the upper surface 43 near the sides 41 thereof are two elongated cavities 45 and 46 which are generally semicircular in transverse cross section. A lug 47 is on each side wall 41 and is upstanding with respect to the surface 43. Each lug 47 has a camming surface 48 and a locking surface 49. An upstanding peg 50 is on the surface 43 and two depending pegs 51 are on the lower surface 44. The upper surface 43 has a groove 52 generally parallel to the cavities 45 and 46, but nearer the cavity 45. Finally, the base plate 40 includes two holes 53 which, in the embodiment shown, lie on a line parallel to the cavities 45 and 46.

Figure 7:
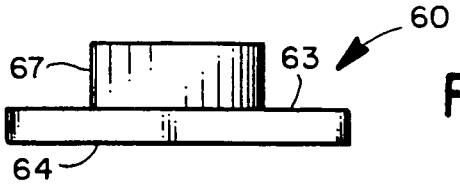
FIG. 7 is an elevational view of the cover plate in the keyboard switch.
Figure 8:
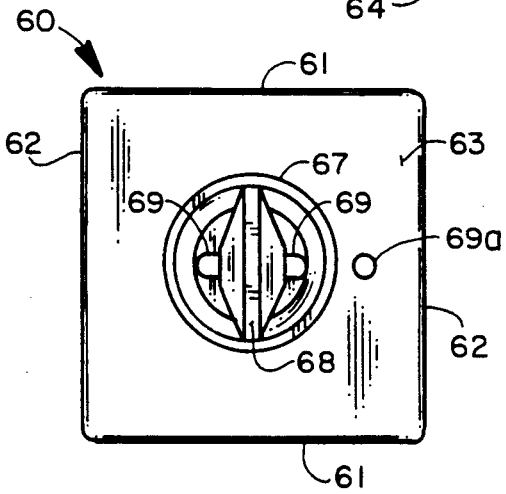
FIG. 8 is a top plan view of the cover plate.
Figure 9:
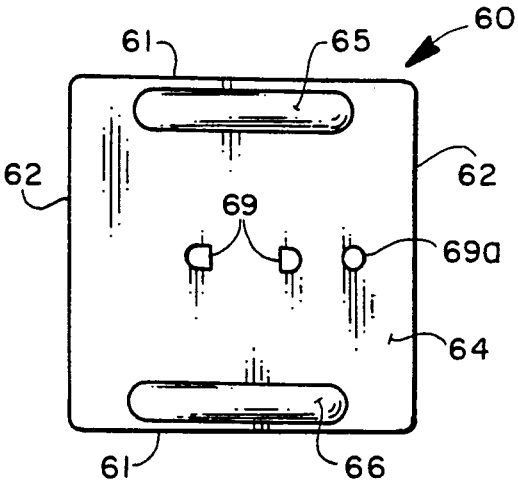
FIG. 9 is a bottom plan view of the cover plate.
Figure 10:
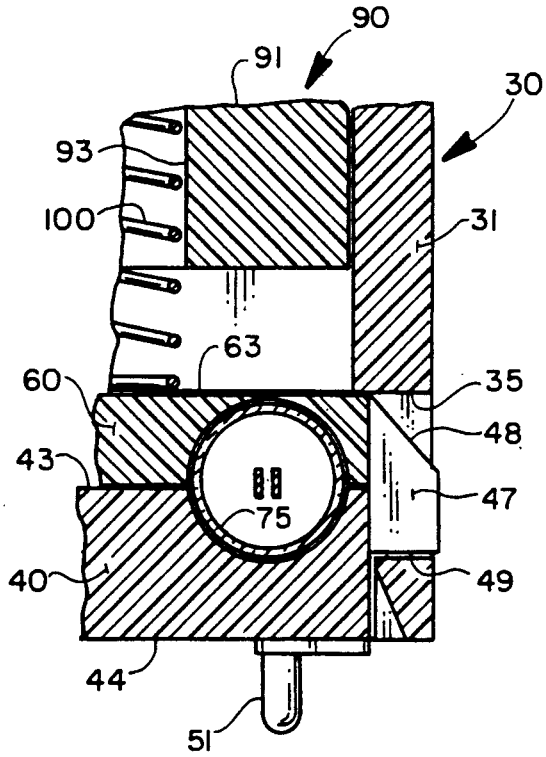
FIG. 10 is a fragmentary view in vertical section taken along the line 10—10 of FIG. 1, on an enlarged scale.

The keyboard switch 20 further comprises a cover plate 60 best seen in FIGS. 7–9. The cover plate is generally square in cross section having two opposite sides 61 and two opposite sides 62. The cover plate 60 has an upper surface 63 and a lower surface 64 which are parallel. Located in the lower surface 64 near the sides 61 thereof are two elongated cavities 65 and 66 which are generally semicircular in transverse cross section. Located generally centrally on the surface 63 and upstanding therefrom is a generally hollow post 67 having a wall 68 transversely therein. The sides of the wall may be flared as shown, leading to two holes 69 through the cover plate 60. The distance between the holes 69 matches the distance between the holes 53 in the base plate 40.

The keyboard switch 20 comprises a pair of receptacles 70, each having a lead 71. Each receptacle 70 has a reduced-diameter body portion, which portions respectively frictionally fit into the holes 53 in the base plate 40. The leads 71 extend away from the lower surface 44.

The keyboard switch 20 further comprises an elongated reed switch 75 of well-known construction. Generally, it consists of an elongated glass envelope which is hermetically sealed and contains an inert gas. In the envelope is a pair of beams which are thin, narrow metal strips that are directed toward one another. At the inner ends of the beams are contacts which are spaced from each other, so that the contacts are normally open. Leads 76 connected to the beams extend out of the glass envelope. When the contacts are oppositely magnetically poled so as to be attracted to each other, they will close. This occurs when they are exposed to a magnetic field with sufficient magnitude to overcome the rigidity of the beams. The keyboard switch 20 further comprises a second reed switch 77 having leads 78 and is identical to the reed switch 75.

The base plate 40 and the cover plate 60 are interconnected in stacked relationship, with the surface 43 of the base plate 40 in contact with the surface 64 of the cover plate 60. The cavities 45 and 65 are aligned, thereby creating a composite cavity in which the reed switch 75 is located. Similarly, the cavities 46 and 66 are aligned, thereby creating a composite cavity in which the reed switch 77 is located. The leads 76 of the reed switch 75 are disposed in grooves **46*a* respectively at the ends of the cavity 46, while the leads 78 of the reed switch 77 are disposed in grooves 45*a* at the ends of the cavity 45. The leads are bent downwardly so as to depend from the base plate 40. The peg 50 fits into the hole 69*a* to help to prevent relative movement of the plates 40 and 60**.

The keyboard switch 20 further comprises a U-shaped clip 80 including a bight 81 and two depending legs 82. The bight 81 is located in the groove 52 of the base plate 40, and the legs 82 depend from the surface 44 of the base plate 40. Each of the legs 82 has a bent portion 83 for springingly engaging holes in the PC board 25.

During factory assembly, the reed switches 75 and 77 are respectively placed in the cavities 45 and 46 of the base plate 40 and the leads 76 and 78 bent as explained above. The clip 80 is placed in the groove 52 also as explained above. Then, the cover plate 60 is positioned above the plate 40 and the plates 40 and 60 are brought together, the cover plate 60 being located between the lugs 47. The spacing between the lugs 47 substantially matches the distance between the wall side 61, thereby causing the plates 40 and 60 to become frictionally secured together. No additional means of attachment is required. The reed switches 75 and 77 are firmly held in place, again, without any additional means of attachment. Then, the subassembly consisting of the plates 40 and 60 is mounted on the housing 30. The subassembly is aligned with the end of the housing 30 opposite the end wall 33. The sides 41 are respectively aligned with the side walls 31, and the sides 42 are respectively aligned with the side walls 32. During assembly, the camming surfaces 48 engage the free ends of the side walls 31 causing them to separate slightly. The plate subassembly is forced onto the housing, causes the lugs 47 respectively to snap into the apertures 35. The locking surfaces 49 preclude retrograde movement of the plate subassembly, thereby firmly connecting the plate subassembly with the housing 30.

The keyboard switch 20 further comprises a plunger 90 including a body 91 which is generally square in plan. A neck 92 extends from an abutment surface 94 at one end of the body 91. A hole 93 extends through the body 91 and the neck 92. The external side-to-side dimensions of the body 91 are slightly smaller than the internal side-to-side dimensions of the housing 30. The neck 92 has four notches 95 to enable slight deformation of the neck when a cap is applied, as will be described. Within the hole 93 is a ledge 96. Extending through the body 91, adjacent to the four corners thereof, are four holes 97, two of which frictionally retain cylindrical magnets 98 and two of which frictionally retain cylindrical magnets 99.

Prior to mounting the plate subassembly, the plunger 90 is inserted into the housing 30. The neck 92 protrudes through the hole 34 in the housing 30, and the abutment surface 94 engages the end wall 33 of the housing 30. A spring 100 is positioned such that one end is within the hole 93 of the plunger 90 and against the ledge 96. The other end of the spring 100 encircles the post 67 on the cover plate 60. Then, the subassembly, including the base plate 40, the cover plate 60 and the elements contained therein, is mounted to the housing as described above.

The spring biases the plunger 90 away from the plates 40 and 60. The magnets 98 are normally displaced from the reed switches 75 and 77, which are, therefore, normally open. The magnets 98 are respectively aligned with the ends of the reed switch 75 and the magnets 99 are respectively aligned with the ends of the reed switch 77. The benefits and mode of operation of two smaller magnets to operate a reed switch are described in detail in the above-mentioned U.S. Pat. No. 3,753,179. Suffice it to say that when the magnetic fields created by the magnets 98 and 99 close the reed switches 75 and 77, respectively, when the plunger 90 is depressed.

The keyboard switch 20 also comprises a lamp 105, the leads 106 of which are frictionally fit into the receptacles 70. Finally, a cap 110 is provided having a depending tubular portion 111 which frictionally is located in the neck 92.

The keyboard switch 20 can be mounted to a PC board. The pegs 51 are placed into holes in the PC board to preclude swiveling of the switch. The leads 76 and 78 of the reed switches extend into holes as do the leads 71 of the receptacles. Suitable electrical connection is made to these leads. The legs 82 of the clip 80 fit into holes in the PC board and the spring portions 83 springingly engage such holes to assist in firmly retaining the switch 20 on the PC board.

Although the particular embodiment depicted includes a lamp and two reed switches, there are applications in which the lamp can be omitted and/or one of the reed switches can be omitted.

Figure 12:
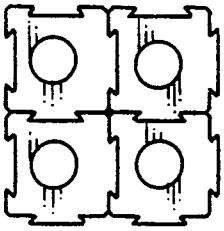
FIG. 12 is a view of four keyboard switches assembled together.
Figure 13:
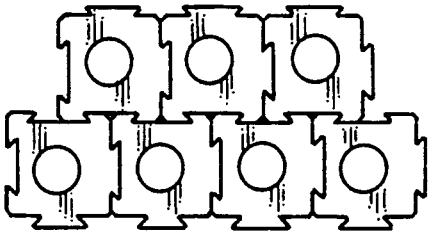
FIG. 13 is a view of six keyboard switches assembled together.

Several keyboard switches 20 may be secured together as depicted in FIGS. 12 or 13 utilizing the dovetail grooves 36 and the dovetail tongues 37 on the housing 30.

Figure 14:
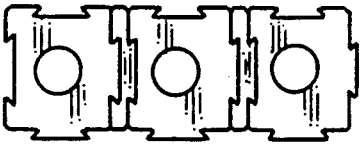
FIG. 14 is a view of three keyboard switches and two spacers assembled together.
Figure 11:
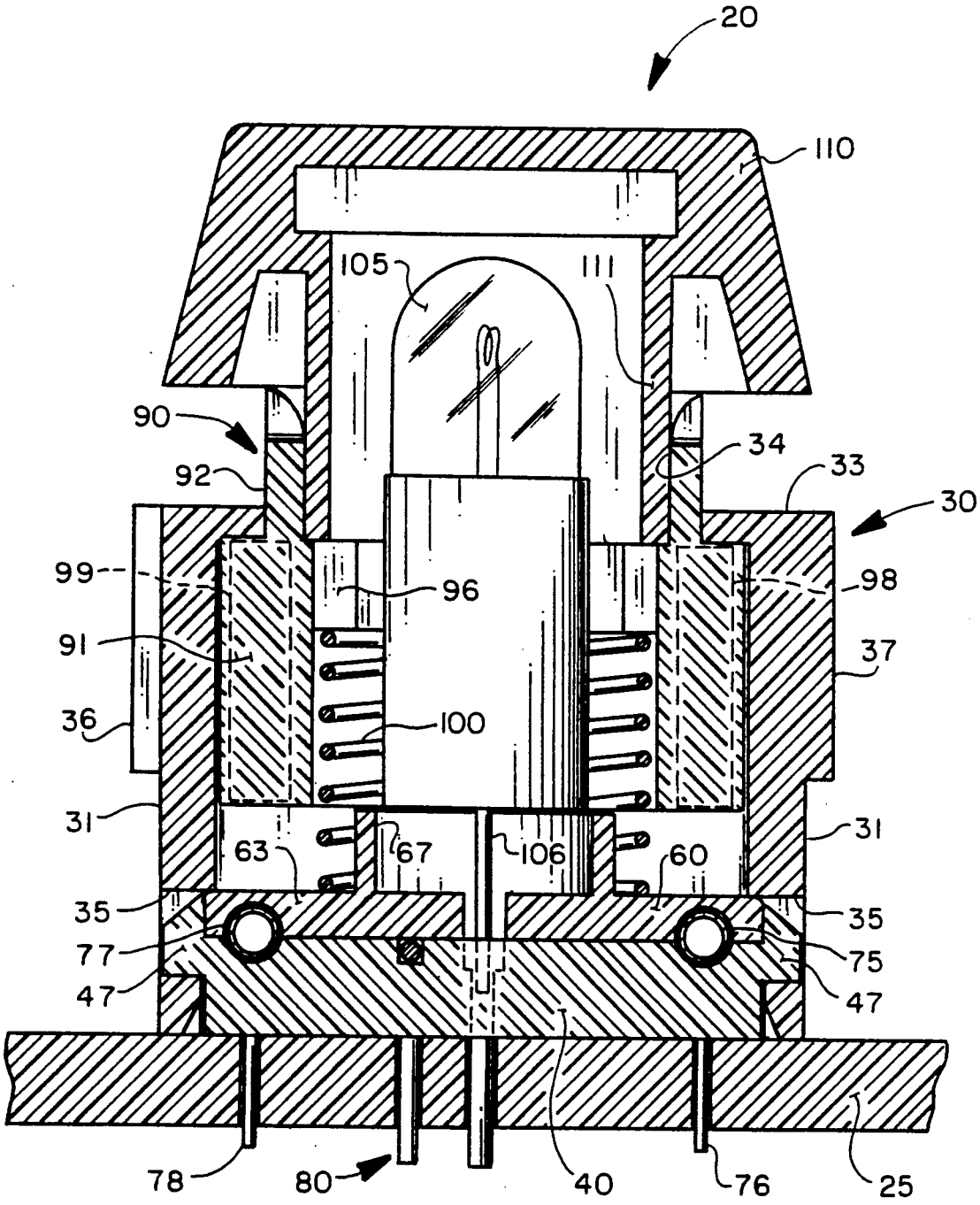
FIG. 11 is a view in vertical section taken along the line 11—11 of FIG. 1, on an enlarged scale.

A spacer 120 is elongated and has two substantially parallel side walls 121. One of the walls carries a dovetail tongue and the other of the walls has a dovetail groove therein. The spacer 120 can be used in assembling keyboard switches 20 in a line as depicted in FIG. 14 to space two keyboard switches 20 from each other.

In the foregoing, switches 75 and 77 are described and depicted as reed switches. However, it is to be understood that these switches can be other magnetically actuated switches, such as those incorporating Hall effect devices. Also, in the particular embodiment depicted, the keyboard switch and its basic elements are square in transverse cross section. They could be rectangular. Also, the reed switches have been described as being normally open, and closed when the cap is depressed. These switches could be normally closed. Finally, although the keyboard switch has been described as single pole, single throw, it could be a single pole, double throw switch.

While there has been described what is at present considered to be the preferred embodiment of the invention, it is to be understood that changes can be made therein without departing from the true spirit and scope of the claims.

We claim:

1. A keyboard switch for mounting on a PC board comprising a housing, an elongated magnetically actuated switch, switch mounting means including a base plate and a cover plate assembled together in stacked relationship and mounted on said housing, at least one of said plates having an elongated cavity therein, said elongated magnetically actuated switch being located in said elongated cavity and being operable between first and second states, said plates having mating surface portions in engagement, frictionally securing said plates together in said stacked relationship to maintain said magnetically actuated switch in said cavity, a plunger slidably carried by said housing and movable normal to the axis of said cavity in said first and second predetermined directions respectively toward and away from said plates, magnet means carried by said plunger and movable therewith, means biasing said plunger in one of said predetermined directions, said magnetically actuated switch being normally in one of said states, said elongated magnetically actuated switching being placed in the other of said states in response to movement of said plunger in one of said predetermined directions and being placed in said one state in response to movement of said plunger in the other of said predetermined directions.

2. The keyboard switch of claim 1, wherein said housing is substantially square in a direction perpendicular to said predetermined directions.

3. The keyboard switch of claim 1, wherein said plates have two sides and said cavity is adjacent to one side thereof.

4. The keyboard switch of claim 1, wherein each of said plates has an elongated cavity, said cavities being aligned and receiving said magnetically actuated switch.

5. The keyboard switch of claim 1, wherein at least one of said plates has a groove, and further comprising a U-shaped clip including a bight portion and two depending legs for insertion into a printed circuit board, said bight portion being disposed in said groove.

6. The keyboard switch of claim 5, wherein each of said legs has a bent portion for springingly engaging the PC board.

7. The keyboard switch of claim 5, wherein said groove is in said base plate.

8. The keyboard switch of claim 1, wherein one of said plates has an upstanding peg and the other of said plates has a hole that receives said peg.

9. A keyboard switch for mounting on a PC board comprising a housing, a base plate and a cover plate interconnected in stacked relationship and mounted on said housing, at least one of said plates having an elongated cavity therein, one of said plates having a pair of upstanding lugs spaced apart a distance substantially equal to the width of the other one of said plates, said other plate being located between said lugs, thereby interconnecting said plates, a plunger slidably carried by said housing and movable in first and second predetermined directions respectively toward and away from said plates, magnet means carried by said plunger and movable therewith, means biasing said plunger in one of said predetermined directions, an elongated magnetically actuated switch in said elongated cavity and having opened and closed positions, said magnetically actuated switch being normally in one of said positions, said elongated magnetically actuated switch being placed in the other of said positions in response to movement of said plunger in one of said predetermined directions and being placed in said one position in response to movement of said plunger in the other of said predetermined directions.

10. The keyboard switch of claim 9, wherein said housing has a pair of holes respectively receiving said lugs.

11. The keyboard switch of claim 9, wherein said housing includes a pair of opposed walls and aligned holes respectively in said walls, each of said lugs having a camming surface and a latching surface, said plates being mounted on said housing by urging said camming surfaces against said walls of said housing apart to force them apart to enable said lugs to snap into said holes, said latching surfaces precluding separation of said plates from said housing.

12. The keyboard switch of claim 1, wherein said base plate has two depending pegs for insertion into holes in the associated PC board.

13. The keyboard switch of claim 1, wherein said plunger has a pair of cylindrical holes generally parallel to said predetermined directions and respectively generally aligned with the ends of said magnetically actuated switch, said magnet means including two magnets respectively in said holes.

14. The keyboard switch of claim 1, wherein said cover plate includes an upstanding post, said post including a central hole therethrough and a ledge in said hole, said biasing means being a spring having first and second ends, one of said ends receiving said post and bearing against said cover plate, the other of said ends bearing against said ledge.

15. The keyboard switch of claim 14 comprising a lamp-mounting socket on said post.

16. The keyboard switch of claim 1, wherein said housing is generally square in plan and includes four side walls, two of said side walls having dovetail tongues thereon and the other two walls having dovetail grooves therein to accommodate interfitting of adjacent housings.

17. The keyboard switch of claim 16, and further comprising an elongated spacer having two substantially parallel side walls, one of said walls having a dovetail tongue thereon and the other of said side walls having a dovetail groove therein, the dovetail groove being adapted to receive the tongue of one housing and the tongue of said spacer being adapted to engage the groove of a second housing.

18. The keyboard switch of claim 16, and further comprising a lamp socket on one of said plates.

19. The keyboard switch of claim 18, wherein said lamp socket includes a pair of receptacles to respectively receive the pins of a lamp.

20. The keyboard switch of claim 1, wherein said magnetically actuated switch is a reed switch operable between open and closed conditions.

21. The keyboard switch of claim 20, wherein said magnetically actuated switch is normally open, said magnetically actuated switch being closed in response to movement of said plunger in said one predetermined direction and being opened in response to movement of said plunger in said other predetermined direction.

22. A keyboard switch for mounting on a PC board comprising a housing, a pair of elongated magnetically actuated switches, switch mounting means including a base plate and a cover plate assembled together in stacked relationship and mounted on said housing, at least one of said plates having two elongated cavities therein, said elongated magnetically actuated switches being located respectively in said elongated cavities and each operable between first and second states, said plates having mating surface portions in engagement, frictionally securing said plates together in said stacked relationship to maintain said magnetically actuated switches in said cavities, a plunger slidably carried by said housing and movable normal to the axis of said cavities in said first and second predetermined directions respectively toward and away from said plates, magnet means carried by said plunger and movable therewith, means biasing said plunger in one of said predetermined directions, one of said magnetically actuated switches being normally in one of said states, the other of said magnetically actuated switches being normally in one of said states, said elongated magnetically actuated switches being placed in the opposite state in response to movement of said plunger in one of said predetermined directions and being placed in their normal states in response to movement of said plunger in the other of said predetermined directions.

23. The keyboard switch of claim 22, wherein each of said plates has two elongated cavities, the two cavities in one plate being respectively aligned with the cavities in the other plate and respectively receiving said magnetically actuated switches.

24. The keyboard switch of claim 22, wherein said plunger has four holes substantially parallel to said predetermined directions, two of said holes being generally aligned with the ends of said first magnetically actuated switch and two of said holes being aligned generally with the ends of said second magnetically actuated switch, said magnet means including four magnets located in said holes.

25. The keyboard switch of claim 22, wherein said magnetically actuated switches are reed switches.

26. The keyboard switch of claim 22 wherein both of said reed switches are in the same states at any one time.

27. The keyboard switch of claim 25, wherein said magnetically actuated switches are normally open, said magnetically actuated switches being open in response to movement of said plunger in said one predetermined direction and being closed in response to movement of said plunger in said other predetermined direction.

28. A keyboard switch for mounting on a PC board comprising a hollow, generally rectangular housing including an end wall and four side walls, said end wall having a hole therethrough, an elongated magnetically actuated switch, switch mounting means including a generally rectangular base plate and a generally rectangular cover plate interconnected in stacked relationship and mounted on said housing, at least one of said plates having an elongated cavity therein, a plunger slidably carried by said housing and movable in first and second predetermined directions respectively toward and away from said plates, said plunger including a generally rectangular body portion and a neck portion, said neck protruding through said hole, magnet means carried by said plunger and movable therewith, first and second side walls of said housing each having an aperture therein, one of said plates having first and second projections received in said first and second apertures, respectively, for securing said switch mounting means to said housing, means interposed between said switch mounting means and said end wall biasing said plunger in one of said predetermined directions, said elongated magnetically actuated switch being located in said elongated cavity and having opened and closed positions, said magnetically actuated switch being normally in one of said positions, said elongated magnetically actuated switch being placed in the other of said positions in response to movement of said plunger in one of said predetermined directions and being placed in said one position in response to movement of said plunger in the other of said predetermined directions.

29. The keyboard switch of claim 28, wherein said housing and said base plate and said cover plate and said body portion are square.

* * * * *